US007946583B2

(12) United States Patent
Bridges

(10) Patent No.: US 7,946,583 B2
(45) Date of Patent: May 24, 2011

(54) ROTARY DIVERTER WITH FUNNEL SECTION

(75) Inventor: Richard Bridges, London (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/581,876

(22) Filed: Oct. 19, 2009

(65) Prior Publication Data

US 2011/0089624 A1 Apr. 21, 2011

(51) Int. Cl.
*B65H 39/10* (2006.01)

(52) U.S. Cl. ..... 271/303; 271/186

(58) Field of Classification Search ..... 271/184–186, 271/303, 306

See application file for complete search history.

(56) References Cited

U.S. PATENT DOCUMENTS

| | | | | | |
|---|---|---|---|---|---|
| 4,871,163 | A * | 10/1989 | Landa et al. | ..... | 271/184 |
| 4,925,178 | A * | 5/1990 | Clabbers et al. | ..... | 271/186 |
| 5,628,258 | A * | 5/1997 | Zwahlen et al. | ..... | 271/303 |
| 6,394,446 | B1 * | 5/2002 | Okamoto | ..... | 271/186 |
| 2006/0071406 | A1 * | 4/2006 | Spencer et al. | ..... | 271/186 |

* cited by examiner

*Primary Examiner* — Stefanos Karmis
*Assistant Examiner* — Gerald W McClain
(74) *Attorney, Agent, or Firm* — Joseph E. Root

(57) ABSTRACT

System for directing media from one an input media path to one of multiple output paths using a rotary diverter. The rotary diverter is a cylinder mounted for rotation at a crossover point, where input media paths and output media paths cross. The rotary diverter includes a funnel-shaped section longitudinally cut through the cylinder, the sides of the funnel-shaped section lying at an acute angle. A relatively narrow output end of the funnel-shaped section lies toward the apex of the angle, and a relatively wide input end lies opposite the apex. The input end is thus configured to receive media, and the output end is configured to output media. The rotary diverter can accept input media from one input media path, or from several paths, given the wide input section.

13 Claims, 3 Drawing Sheets

ROTARY DIVERTER WITH FUNNEL SECTION

TECHNICAL FIELD

The presently disclosed embodiments relate to image forming devices and more particularly, to devices that direct sheet media from input paths to output paths within an imaging device.

BACKGROUND

An image forming apparatus, such as a printer, a fax machine, or a photocopier, includes devices for directing sheet media along a media path. A media path generally begins with an input section for introducing the sheet media and includes a transfer point, where the sheet media receive an image from an imaging device, such as a xerographic photoreceptor or ink jet printhead, for example. Often the sheet media can be inverted and reintroduced into the media path upstream from the transfer point to receive another image on a second side. The path taken for sheet inversion and imaging on the second side of the sheet is called the duplex path. Moreover, the sheet media can be directed to a finisher device. Such a device performs various media handling operations such as punching, stapling, etc. The media path may further include an output section, such as an output paper tray, where the sheet media exit from the image forming apparatus.

Typically, image forming devices include guiding surfaces such as gates for routing sheet media to different media paths. The gate may be positioned at a variety of locations along the path, such as the input section, the transfer point, the duplex area, and output section. The image forming devices may also use rotary diverters for diverting media sheets.

Conventional rotary diverters include a longitudinal section through their length to divert media. This longitudinal section allows media from an input path to be directed to only one output path. Known rotary diverters, however, do not provide capabilities to direct media from one of multiple input paths to one of multiple output paths. Other image-forming devices may employ gating systems to divert media. The gating systems, referred to as two-way gates, are able to switch media only between two output paths. To divert sheet media to more than two paths, present methodologies must employ sequential two-way gates, resulting in higher costs and increased space.

Thus, there remains a need for a media diverter that guides media from multiple input paths to multiple output paths and reduces cost, and space.

SUMMARY

The present disclosure provides a media feeding system for guiding media. The media feeding system includes an input portion providing media to the media feeding system. The system includes an imaging portion including a transfer point and a fuser point configured to transfer image onto media. The system also includes a plurality of media trays including one or more sheets arranged in a stack. A rotary diverter, operatively coupled to the imaging portion, and the plurality of media trays, guides media. The rotary diverter is cylinder having a funnel-shaped section cut longitudinal though the length of the cylinder for guiding media. The rotary diverter receives media from the imaging portion or one of the plurality of media tray and divert the media to a selected media tray from the plurality of media trays.

Another disclosed embodiment is a rotary diverter for diverting media from a plurality of input media paths to one of a plurality of output media paths, at a crossover point where the input media paths and the output media paths cross. The rotary diverter is a cylinder, mounted for rotation at the crossover point, which includes a funnel-shaped section longitudinally cut through the length of the cylinder. The wider section of the funnel constitutes an input section for receiving media from an input media path and the narrower section of the funnel guides the media to one of the plurality of output media paths. The rotary diverter is configured to direct media from a single input media path to one of multiple output media paths.

Another disclosed embodiment is a method for diverting media through a rotary diverter. The method includes receiving media from a first media path and diverting the media to a second media path through a rotary diverter. The rotary diverter used for guiding the media is a cylindrical diverter, mounted for rotation at a center point, including a funnel-shaped section cut longitudinally through the cylinder. The method includes positioning the rotary diverter positions to receive input from the second media path and diverting it to a third media path. As a result, the rotary diverter inverts the media by guiding it from the first media path to the second media path and finally to the third media path. The method inverts orientation-sensitive media, such as tabbed media, pre-punched media, or pre-printed media.

DETAILED DESCRIPTION

The following detailed description is made with reference to the figures. Preferred embodiments are described to illustrate the disclosure, not to limit its scope, which is defined by the claims. Those of ordinary skill in the art will recognize a number of equivalent variations in the description that follows.

The present disclosure describes a method and system for diverting media in an imaging device, in which a cylindrical rotary diverter guides media from one of multiple input media paths to one of multiple output media paths. Further, the rotary diverter provides an ability to divert media from a single media path to one of multiple output paths. The media diverter described in the disclosure also improves productivity of the imaging device by increasing the number of prints per minute (PPM) using the capability of inverting media and promotes economy by employing a single diverter structure.

Figure 1:
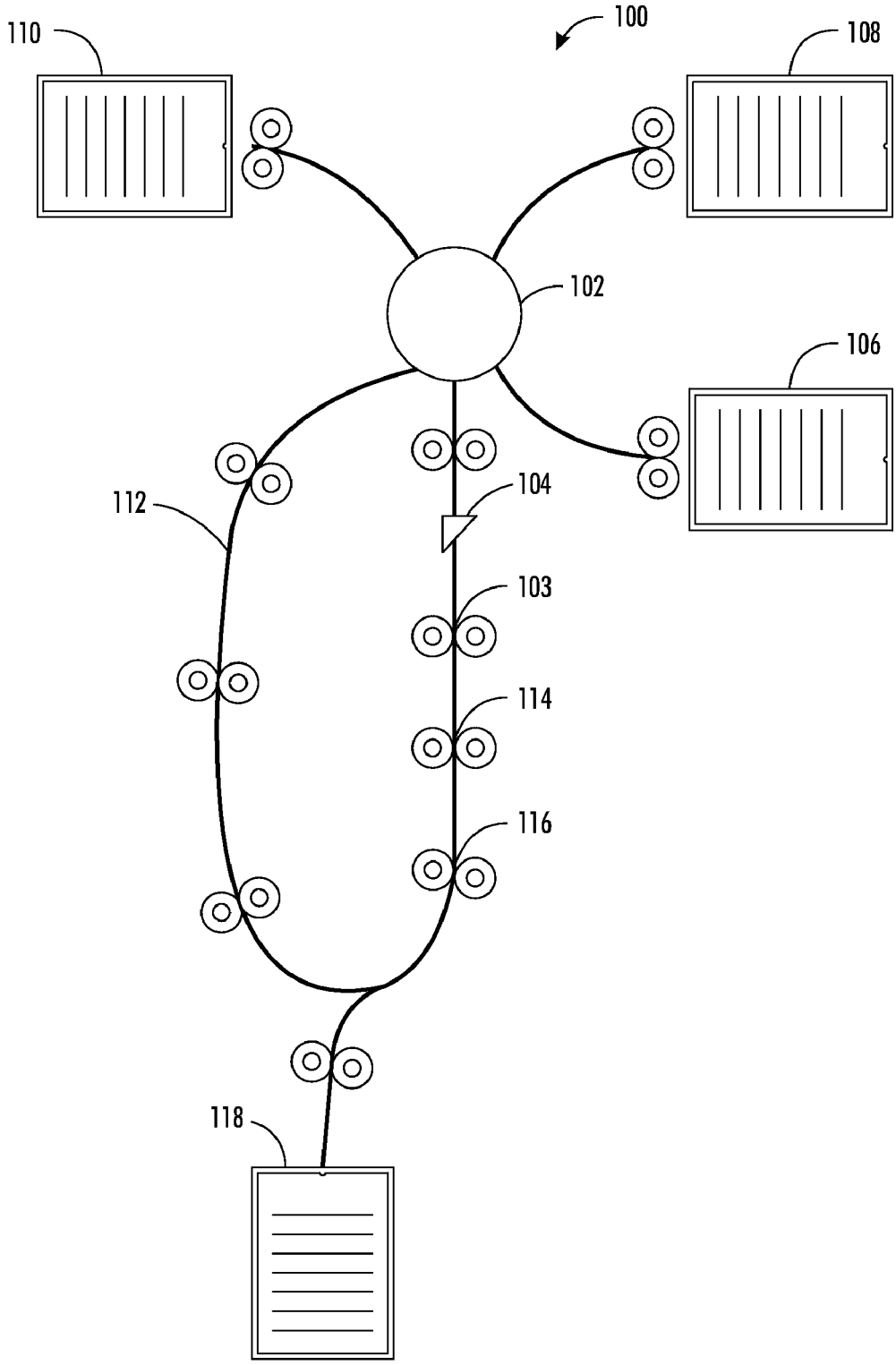
FIG. 1 illustrates an exemplary embodiment of an imaging apparatus employing a rotary diverter

FIG. 1 illustrates an exemplary embodiment of an imaging device 100 that employs a rotary diverter 102 for diverting media from one of multiple input paths to one of multiple output paths. Those skilled in the art, however, will appreciate that various other embodiments of an imaging device can be anticipated in which the rotary diverter 102 can be employed to divert media.

In the following description the terms "media" and "sheet" refer to sheets of paper, plastic, cardboard, or other suitable physical substrate for printing images, whether precut or initially web-fed and then cut. Those terms are interchangeable, used throughout the disclosure. Moreover, the term "media paths" and "paths" are also interchangeably employed below.

The imaging device 100 can best be understood by considering the media path described by sheets processed within the device. As shown, sheets encounter the rotary diverter 102, a fuser nip 103, a diverter 104, a lower right output tray 106, an upper right output tray 108, an upper left output tray 110, and a duplex loop 112.

The fuser nip 103 includes two rollers mounted in parallel and in contact to form a nip. Media carrying toner passes through the nip, fusing the image. The fuser nip 103 is coupled to a transfer nip 114 and a registration nip 116. A paper tray 118 provides media to the imaging device 100; typically media passes through the registration nip 116 and the transfer nip 114, which transfer toner image to the media, and then on to the fuser nip 103. This arrangement is known in the art and will not be described in further detail.

For purposes of clarity, and to describe the application of the claimed invention, the media employed in the embodiment of FIG. 1 is tab media, having tabs on one edge used as section dividers and the like. In general, tab media is referred to as orientation-sensitive media, as the tabs define the direction and orientation of the sheets. Other orientation-sensitive media include pre-punched and pre-printed sheets, and similar media known in the art and requiring no further detailed description here.

The imaging device 100 is a typical imaging device used for printing media, such as sheet paper. For imaging, media follows a substantially upward and vertical path from the paper tray 118 to an imaging path including the transfer nip 114 and the fuser nip 103. Conventionally, in place of the rotary diverter 102, the imaging device 100 employs a typical diverter, such as a gate, a guiding device, or other devices known in the art. For imaging, the tab media is fed to the imaging device 100 from the paper tray 118 with tabs trailing, and the media is finally collected on one of the output trays 106, 108, or 110 with tabs leading. The tab media must be received with tabs leading for compiling or finishing purposes. The path followed by tab media within the imaging device 100 is referred to as a feeding sequence.

For simplex (one-sided) imaging, tab media in the imaging device 100, employing a typical diverter, employs the following feeding sequence. The sequence starts with feeding the tab media to the imaging device 100 with tabs trailing. The tab media passes through the transfer nip 114, and the fuser nip 114, which transfers an image onto the media. Next, the typical diverter guides the imaged tab media to the upper right output tray 108. To arrive at a desired tray with tabs leading, this media passes through the duplex loop 112. The media traverses the duplex loop 112, the registration nip 116, the transfer nip 114, and the fuser nip 103 to finally reach the desired output tray, such as the output tray 108. The conventional feeding sequence requires feeding the tab media to the duplex loop 112, which inverts the direction of the tabs. For simplex imaging, feeding the tab media to the duplex loop 112 and to the transfer nip 114 without imaging results in lower PPM rates as an opportunity for imaging is lost, reducing the overall efficiency of the imaging device 100.

The rotary diverter 102 resolves the efficiency issues of the conventional diverters by simplifying the feeding sequence of the tab media. As described with the conventional diverters, tab media is fed from the paper tray 118 with tabs trailing, passing through the registration nip 116, the transfer nip 114, and the fuser nip 103 for simplex imaging. Once one side of the tab media is imaged, the rotary diverter 102 guides the tab media to the upper left output tray 110. To this end, the input end of the rotary diverter 102 is aligned to receive the tab media from the fuser nip 103 and the output end of the rotary diverter 102 delivers the tab media to the upper left output tray 110.

Subsequently, the rotary diverter 102 inverts the tab direction of the tab media in the feeding sequence and directs the tab media to a desired output tray with tabs leading. For inversion, the rotary diverter 102 aligns the input with the upper left output tray 110 and the output end with the lower right output tray 106. As the tab media passes through the rotary diverter 102 from the upper left output tray 110, the lower right output tray 106 receives the tab media with tabs leading. To summarize, passing the tab media from a first media path, including media imaging, to a second media path through the rotary diverter and directing the media path from the second media path to a third path results in inverting the direction of the tabs in the media feeding sequence. Consequently, the rotary diverter 102 avoids the duplex path 112 in the feeding sequence of the tab media. As a result, the PPM rate for the imaging device 100 increases, as the media never pass through the transfer nip 114 without imaging, resulting in higher efficiency.

The rotary diverter 102 inverts the direction of any known orientation-sensitive media in the feeding sequence. In case of pre-punched media, the imaging device 100 receives media from the paper tray 118 with holes leading and is directed to the output tray with holes trailing. As discussed, the rotary diverter 102 reduces the path traversed by orientation-sensitive media. The structure of the rotary diverter 102 will be explained in detail in the following sections. Moreover, the rotary diverter receives media from one of multiple input paths and guides media to one of multiple output paths.

The imaging device 100 employs a single rotary diverter, such as the rotary diverter 102, coupled to a single actuator for guiding media, resulting in a compact and cost effective imaging device.

Figure 2:
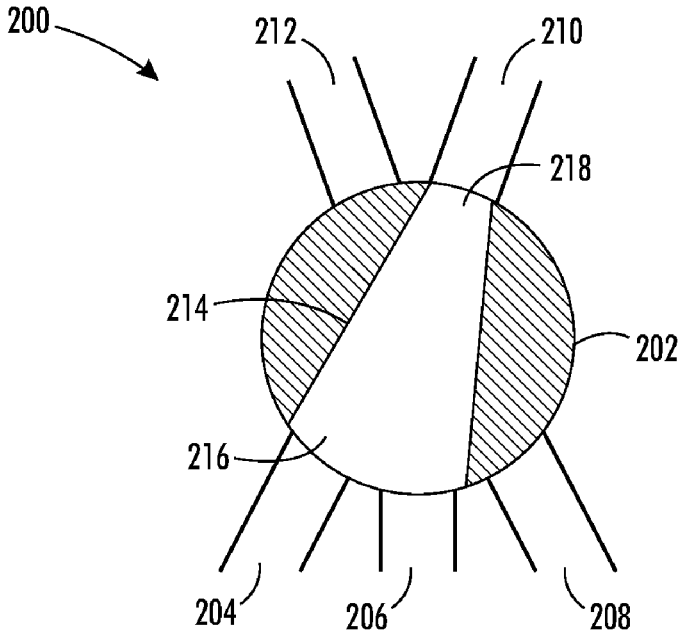
FIG. 2 is a schematic drawing of an exemplary embodiment of a rotary diverter.

FIG. 2 is a schematic drawing of an exemplary embodiment of a rotary diverter 200 for diverting media from one of multiple input paths to one of multiple output paths. The rotary diverter 200 can be employed in the imaging device 100, shown in FIG. 1. The rotary diverter 200 may also be employed within a device such as a copier, a printer, a facsimile machine, or a finisher where a sheet is required to be directed from/to multiple paths to perform various operations, such as, printing, copying, stapling, punching, etc. Various other embodiments can be anticipated, however, to address many different systems or applications in which sheet media must be directed along multiple paths.

It should be noted that the description below does not set out specific details of manufacture or design of the various components. Those of skill in the art are familiar with such details, and unless departures from those techniques are set out, techniques, designs and materials known in the art should be employed. Those in the art are capable of choosing suitable manufacturing and design details.

The rotary diverter 200 includes a cylinder 202 (shown in FIG. 2), a set of input paths 204, 206, and 208, and a set of output paths 210 and 212. The rotary diverter 200 also includes a funnel-shaped section 214 longitudinally cut through the cylinder 202. The sides of the funnel-shaped section 214 lie at an acute angle, forming a relatively wide input section 216 and a relatively narrow output section 218. The rotary diverter 200 is mounted for rotation about the center of the cylinder 202. As illustrated, the rotary diverter 200 diverts media from the input media path 206 to the output media path 210.

As shown, the input paths 204, 206, and 208 deliver media to the wider input section 216 of the rotary diverter 200 for diversion to one of the output paths 210 or 212, through the narrower output section 218. The wider input section 216 of the funnel 214 allows for lower alignment tolerance and enables receiving media from more than one input paths. The narrower output section 218 ensures delivering the media a desired output media path.

Further, the rotary diverter 200 allows media from one input media path, such as the input path 206, to be diverted to one of multiple output paths, for example the output media path 210, or 212. The funnel 214, with the wider input section 216, provides the capability of aligning an input path with more than one output media paths. This feature of the rotary diverter 200 will be explained in detail in connection with FIGS. 3-5.

Another application of the rotary diverter includes inverting the direction of media within an imaging device, as discussed in connection with FIG. 1.

For simplicity, the embodiment depicts only three input media paths 204, 206, and 208 and two output media paths 210, and 212, however, a person skilled in the art would appreciate that more input and output media paths may be directed to and from the rotary director 102 to render more capabilities. Further, the rotary diverter 200 may include just two input media paths to simply route sheet media to one of the two output media paths. Further, the media paths 204, 206, and 208 are labeled as the input media paths and the media paths 210, and 212 are labeled as the output media paths. It should be understood that based on the orientation of the rotary diverter 200, the input media paths can act as the output media paths and vice versa.

The input media paths 204, 206 and 208, and the output media paths 210 and 212 may also include guiding elements to help direct sheets to the desired section in an imaging device. Typically, baffles and rollers are employed to perform this guiding process; such devices are well known in the art and will not be described in detail here. The media paths can include a sheet metal baffle assembly, molded plastic baffle assembly, or any other baffle assembly known in the art. Further, it will be appreciated by those skilled in the art that any other guiding elements known in the art can be employed here.

The rotary diverter 200 is coupled to an actuator, not shown in FIG. 2, configured to position the rotary diverter 200. The actuator aligns the rotary diverter 200 with one of the input media paths 204, 206, or 208 and one of the output media paths 210, or 212, forming a media path for a sheet. For example, the actuator could be a stepper motor, connected to the rotary diverter 200 by an actuator rod. Those skilled in the art will be able to select from conventional components, such as solenoids and the like, as well as various means for operatively connecting the actuator to the rotary diverter 102.

The rotary diverter 200 is also coupled to a control mechanism to accomplish the orientation of the rotary diverter 102 at any point of time. Those skilled in the art will be able to select a conventional control mechanism, such as a computer controlled mechanism, an electromechanical mechanism, or any other suitable mechanism known in the art, for the rotary diverter 200.

The claimed rotary diverter can be employed in a media feeding system, such as the imaging device 100, where the rotary diverter couples the various components of the media feeding system to provide an efficient imaging means. The media feeding system includes an input portion that provides media to the system for imaging, an imaging portion, and the rotary diverter. An imaging portion coupled to the input portion may include a number of marking devices as a registration nip, a transfer nip, and a fuser nip to enable transferring of images onto the received media. The media feeding system also includes a set of media trays, which includes a set of sheets arranged in a stack. During operation, media may be diverted to one of multiple paths, such as a selected output tray, a finisher attached to the system, a duplex loop to facilitate duplex imaging, or other known paths within the media feeding system. The rotary diverter renders capabilities of diverting media among one the multiple paths. Moreover, the rotary diverter facilitates inversion of media, as discussed in connection with FIG. 1.

Figure 3:
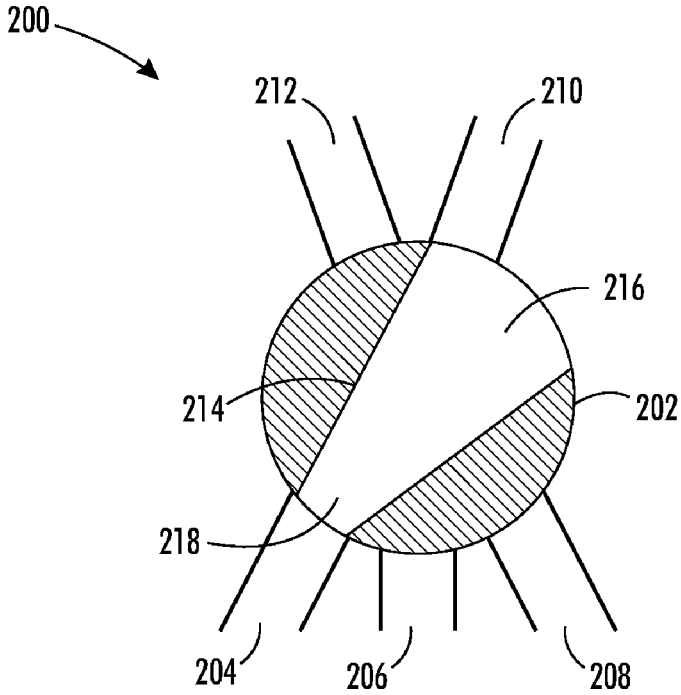
FIG. 3, FIG. 4, and FIG. 5 are schematic drawings of the embodiment of FIG. 2, showing different orientations of the diverter.
Figure 4:
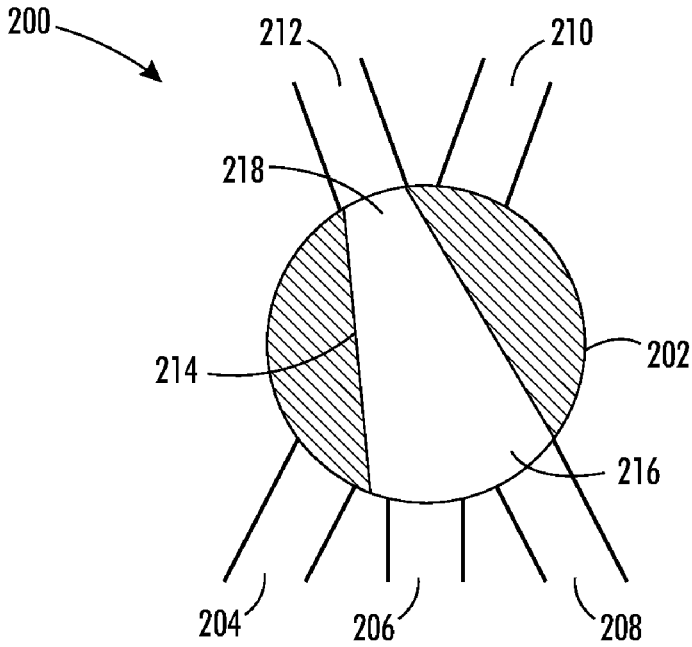
Figure 5:
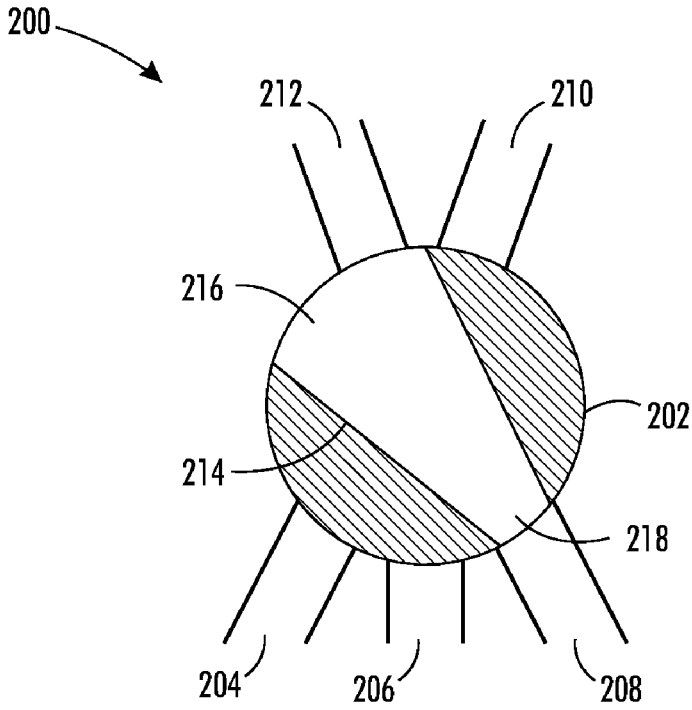

FIGS. 3-5 illustrate alternate orientations of the rotary diverter 200. The rotary diverter 200 aligns one of multiple input media paths with one of multiple output media paths, forming a media path. An actuator, not illustrated in FIGS. 3-5, positions the rotary diverter 200 in the desirable direction, forming alternate media paths as shown.

FIG. 3 depicts the orientation of the rotary diverter 200 between two media paths, 210 and 204. The media path 210 acts as an input path and directs media to the output media path 204. It should be understood that terms "input media path", "media path", and "output media path" are interchangeably used in connection with FIGS. 3-5, as input path may act output path based on the orientation of the rotary diverter 200.

FIG. 4 depicts the arrangement of the rotary diverter 200 to direct media from the media path 206 to the output media path 212, and FIG. 5 illustrates the positioning of the rotary diverter 200 to divert media from the media path 212 to the media path 208.

As shown in FIG. 2 and FIG. 4, the rotary diverter 200 allows directing media from the media path 206 to the media path 210, or the media path 212. The funnel-shaped section 214 of the rotary diverter renders this capability of aligning an input path with more than one output paths. Moreover, the rotary diverter 200 enables guiding media from one of multiple input media path to one of multiple output media paths.

As discussed, a rotary diverter guides media from one of multiple input paths to one of multiple output paths and renders capabilities of inverting media in a simplified and efficient manner.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A rotary diverter for diverting media from a plurality of input media paths to one of a plurality of output media paths, at a point where the input media paths and the output media paths cross at a crossover point, the rotary diverter comprising:

a cylinder, mounted for rotation at the crossover point, having a funnel-shaped section longitudinally cut therein, the sides of the entire funnel-shaped section lying at an acute angle, forming a relatively narrow output end toward the apex of the angle, for outputting media, and a relatively wide input end opposite the apex, for receiving media, wherein there is an empty space between the sides.

2. The rotary diverter of claim 1, wherein the input section enables the rotary diverter to receive the media from one of the plurality of input media paths.

3. The rotary diverter of claim 2, wherein the input section diverts the media from the input media path to one of the plurality of output media paths.

4. The rotary diverter of claim 1, wherein the rotary diverter is further configured to invert the media.

5. The rotary diverter of claim 4, wherein the rotary diverter inverts the media by passing the media through the rotary diverter from a first media path to a second media path and then from the second media path to a third media path.

6. The rotary diverter of claim 4, wherein the media is orientation-sensitive media.

7. The rotary diverter of claim 1, wherein the rotary diverter is operatively coupled to an actuator for controlling the rotation of the rotary diverter.

8. A media feeding system comprising:

an input portion providing media to the media feeding system;

an imaging portion including a transfer point and a fuser point configured to transfer an image onto the media;

a plurality of media trays including media arranged in a stack; and a rotary diverter operatively coupled to the imaging portion, and the plurality of media trays, the rotary diverter is configured to receive media from the imaging portion or one of the plurality of media trays and divert the media to a selected media tray from the plurality of media trays, wherein the rotary diverter is a cylinder, having a funnel-shaped section longitudinal cut therein to guide media, wherein sides of the entire funnel-shaped section lie at an acute angle, forming a relatively narrow output end toward the apex of the angle, for outputting media, and a relatively wide input end opposite the apex, for receiving media;

wherein there is an empty space between the sides.

9. The system of claim 8 further including an actuator configured to control the rotation of the rotary diverter.

10. The system of claim 8, wherein the media follows an upward, vertical path from the input portion to the imaging portion.

11. The system of claim 8, wherein the rotary diverter is further configured to invert media, including:

transferring the media from the imaging portion to the selected media tray; and diverting the media from the selected media tray to a media tray from the plurality of media trays through the rotary diverter.

12. The system of claim 11, wherein the media is orientation-sensitive media.

13. The method of claim 11, wherein the media is tab media.

* * * * *